US010920523B2

(12) United States Patent
Kellner

(10) Patent No.: US 10,920,523 B2
(45) Date of Patent: Feb. 16, 2021

(54) BALL DROP WIRELINE ADAPTER KIT

(71) Applicant: INNOVEX DOWNHOLE SOLUTIONS, INC., The Woodlands, TX (US)

(72) Inventor: Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 152 days.

(21) Appl. No.: 16/131,802

(22) Filed: Sep. 14, 2018

(65) Prior Publication Data

US 2020/0088006 A1 Mar. 19, 2020

(51) Int. Cl.

| | |
|---|---|
| ***E21B 33/12*** | (2006.01) |
| *E21B 33/128* | (2006.01) |
| *E21B 33/129* | (2006.01) |

(52) U.S. Cl.

CPC ..... *E21B 33/12* (2013.01); *E21B 33/128* (2013.01); *E21B 33/1293* (2013.01)

(58) Field of Classification Search

CPC .... E21B 33/12; E21B 33/128; E21B 33/1293; E21B 33/134

See application file for complete search history.

(56) References Cited

U.S. PATENT DOCUMENTS

2014/0352970 A1* 12/2014 Kristoffer ..... E21B 43/12 166/318

* cited by examiner

*Primary Examiner* — Giovanna Wright
*Assistant Examiner* — Yanick A Akaragwe
(74) *Attorney, Agent, or Firm* — MH2 Technology Law Group LLP

(57) ABSTRACT

A downhole tool includes an outer sleeve and an inner sleeve positioned at least partially within the outer sleeve. An impediment is positioned at least partially within the inner sleeve. A first retainer is positioned at least partially within the inner sleeve. The first retainer is configured to prevent the impediment from passing therethrough when a force on the impediment is less than a predetermined amount. The impediment, the first retainer, or both is/are configured to allow the impediment to pass through the first retainer when the force on the impediment is greater than the predetermined amount. A second retainer is configured to actuate between a first position and a second position. The second retainer in the first position is configured to prevent the impediment from passing through the first retainer. The second retainer in the second position is configured to allow the impediment to pass through the first retainer.

20 Claims, 5 Drawing Sheets

BALL DROP WIRELINE ADAPTER KIT

BACKGROUND

A frac plug is introduced into a wellbore to isolate a portion of the wellbore above the frac plug from a portion of the wellbore below the frac plug. More particularly, after being run into the wellbore, the frac plug may be set by expanding a portion of the frac plug radially-outward to engage a surrounding tubular (e.g., a liner, a casing, a wellbore wall, etc.). This may secure the frac plug in place. Typically, after perforating guns are fired to create the perforations in the formation to be treated, the wireline assembly is pulled to surface. A ball is then pumped down from the surface which comes to rest on a seat defined by an inner surface of the frac plug. The ball may form a seal on the seat, preventing fluid flow therethrough in a downhole direction while allowing fluid flow therethrough in an uphole direction (e.g., through the perforations).

However, dropping the ball from the surface and pumping it to the plug seat requires additional pumping time and displacement fluid. Accordingly, frac plugs have been developed in which the ball is run in with the frac plug, e.g., as part of a wireline adapter kit that connects the setting assembly to the plug. The ball is generally free-floating in the adapter kit and released to engage the frac plug once the frac plug is set. An issue arises, however, when the perforating guns fail to actuate. The ball will impede flow through the plug such that a contingent set of perforating guns cannot be pumped down to the desired location. Generally, the contingent set of perforating guns will be pushed to the bottom on coil tubing adding time and cost to the operation.

SUMMARY

A downhole tool is disclosed. The downhole tool includes an outer sleeve and an inner sleeve positioned at least partially within the outer sleeve. An impediment is positioned at least partially within the inner sleeve. A first retainer is positioned at least partially within the inner sleeve. The first retainer is configured to prevent the impediment from passing therethrough when a force on the impediment is less than a predetermined amount. The impediment, the first retainer, or both is/are configured to allow the impediment to pass through the first retainer when the force on the impediment is greater than the predetermined amount. A second retainer is configured to actuate between a first position and a second position. The second retainer in the first position is configured to prevent the impediment from passing through the first retainer even when the force is greater than the predetermined amount. The second retainer in the second position is configured to allow the impediment to pass through the first retainer.

A system for isolating a portion of a wellbore is also disclosed. The system includes a wireline adapter kit that includes an outer sleeve and an inner sleeve positioned at least partially within the outer sleeve. An impediment is positioned at least partially within the inner sleeve. A first retainer is positioned at least partially within the inner sleeve. The first retainer is configured to prevent the impediment from passing therethrough when a force on the impediment is less than a predetermined amount. The impediment, the first retainer, or both is/are configured to deform to allow the impediment to pass through the first retainer when the force on the impediment is greater than the predetermined amount. A second retainer is configured to actuate between a first position and a second position. The second retainer in the first position is configured to prevent the impediment from passing through the first retainer. The second retainer in the second position is configured to allow the impediment to pass through the first retainer. A plug is configured to be coupled to the inner sleeve. The plug includes a setting assembly comprising one or more expandable components. The outer sleeve pushes on the setting assembly.

A method for actuating a plug in a wellbore is also disclosed. The method includes running a wireline adapter kit and the plug into the wellbore. An inner sleeve of the wireline adapter kit is coupled to a mandrel of the plug as the wireline adapter kit and the plug are run into the wellbore. A first retainer is positioned at least partially within the inner sleeve and prevents an impediment in the inner sleeve from passing therethrough and into the plug when a force on the impediment is less than a predetermined amount. The plug is set in the wellbore using the wireline adapter kit. The inner sleeve is decoupled from the mandrel after the plug is set, which allows a second retainer in the inner sleeve, the mandrel, or both to actuate from a first position that prevents the impediment from passing through the first retainer to a second position that allows the impediment to pass through the first retainer. A pressure differential across the impediment is increased after the wireline adapter kit is decoupled from the plug, thereby causing force on the impediment to exceed the predetermined amount such that the impediment passes through the first retainer and into the plug.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
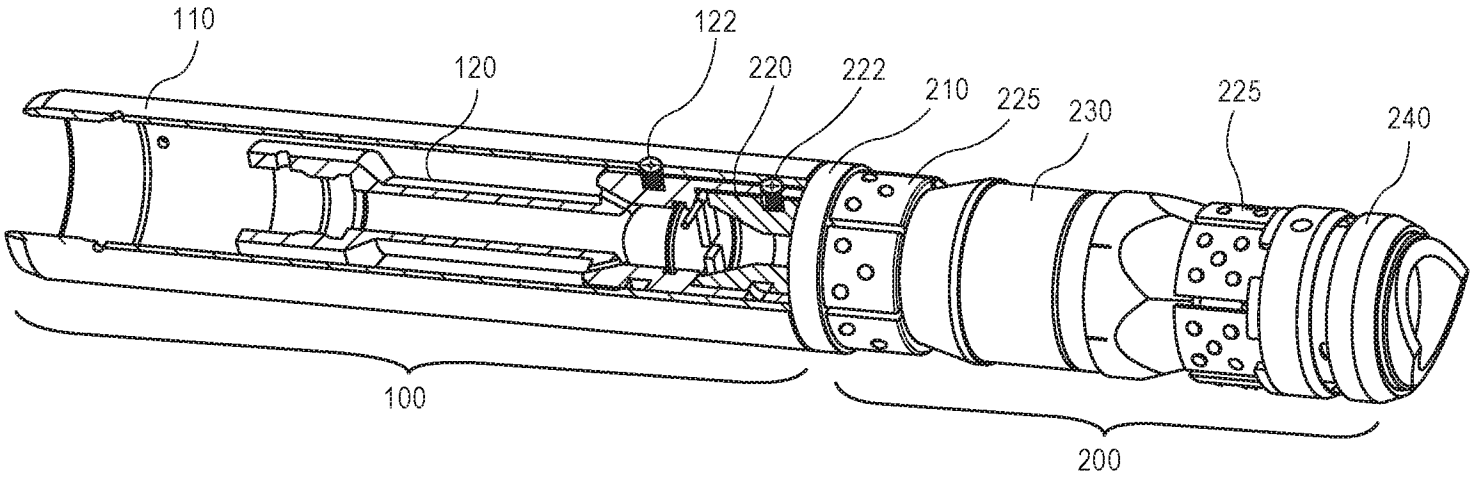
FIG. 1 illustrates a perspective view of a wireline adapter kit (with a quarter section removed) coupled to a plug, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure provide a wireline adapter kit (WLAK) for setting a plug in a wellbore. As described in greater detail below, the wireline adapter kit may include an outer sleeve and an inner sleeve positioned at least partially within the outer sleeve. An impediment (e.g., a ball) may be positioned at least partially within the inner sleeve (e.g., as the wireline adapter kit is run into the wellbore). A first retainer may be positioned at least partially within the inner sleeve. The first retainer is configured to prevent the impediment from passing therethrough when a force on the impediment is less than a predetermined amount, and the impediment, the first retainer, or both is/are configured to deform to allow the impediment to pass through the first retainer when the force on the impediment is greater than the predetermined amount. A second retainer is configured to actuate between a first position and a second position. The second retainer is configured to prevent the impediment from passing therethrough when in the first position, and the second retainer is configured to allow the impediment to pass therethrough when in the second position.

Turning now to the specific, illustrated embodiments, FIG. 1 illustrates a perspective view of a downhole tool (e.g., a wireline adapter kit 100 coupled to a plug 200), according to an embodiment. In one example, the downhole tool includes the wireline adapter kit 100 and any parts of the plug 200 that are used to set the plug 200. The wireline adapter kit 100 has a quarter section removed to show the internal components thereof. The wireline adapter kit 100 may be used to connect the plug to a wireline and to set the plug 200 in a wellbore at a predetermined location. The plug 200 may be or include a frac plug.

The wireline adapter kit 100 may include an outer (e.g., setting) sleeve 110 and an inner sleeve (also referred to as a shear cap) 120. The outer sleeve 110 and the inner sleeve 120 may be coupled together via one or more first fasteners (e.g., shear screws) 122. A lower axial end of the outer sleeve 110 may contact an upper axial end of the plug 200. More particularly, the lower axial end of the outer sleeve 110 may contact a load ring 210 that is positioned proximate to the upper axial end of the plug 200. A lower axial end of the inner sleeve 120 may be coupled to an upper axial end of a mandrel 220 of the plug 200 via one or more second fasteners (e.g., shear screws 222).

The wireline adapter kit 100 may be used to set the plug 200 by expanding a setting assembly thereof radially outwards. In particular, the outer sleeve 110 may push the load ring 210 in a downward direction (to the right in the Figure) and/or pull the inner sleeve 120 (and the mandrel 220) in an upward direction (to the left in the Figure). This may cause the load ring 210 to move downward with respect to the mandrel 220, thereby expanding the setting assembly, e.g., by axially-compressing one or more slips 225, and one or more sealing elements 230 positioned around the mandrel 220 between the load ring 210 and a shoulder or shoe 240 proximate to a lower end of the plug 200. The axial compression of the slips 225 and sealing elements 230 may cause the slips 225 and the sealing elements 230 to expand radially-outward and engage a surrounding tubular (e.g., a liner, a casing, a wellbore wall, etc.) as the plug 200 is set in the wellbore.

Figure 2:
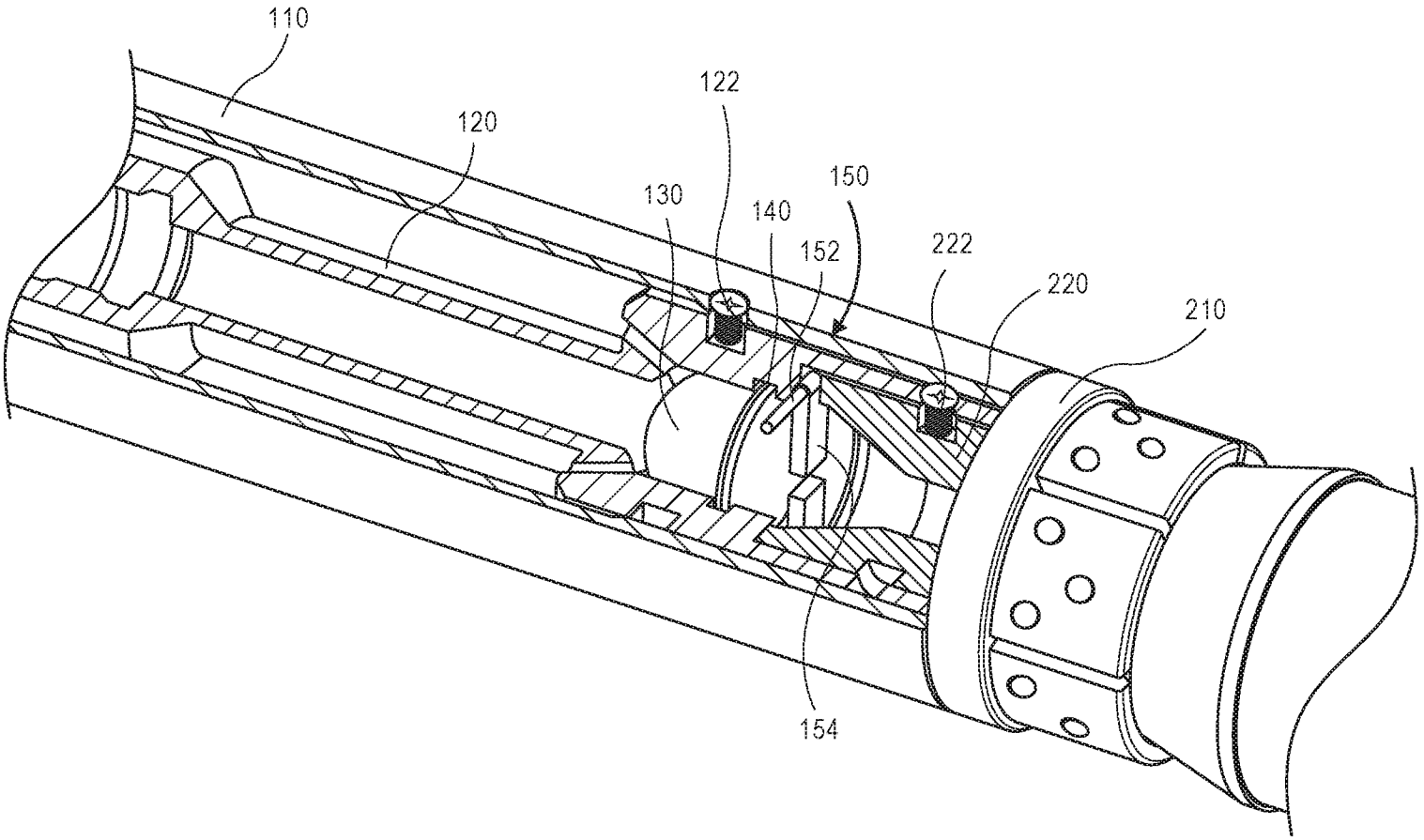
FIG. 2 illustrates an enlarged view of a portion of FIG. 1, according to an embodiment.

FIG. 2 illustrates an enlarged view of a portion of FIG. 1, according to an embodiment. As shown, an impediment (e.g., a ball) 130 may be positioned at least partially within the inner sleeve 120. The ball 130 may be positioned within the inner sleeve 120 while the wireline adapter kit 100 is run into the wellbore, as the plug 200 is set, and (at least temporarily) after the plug 200 is set. The ball 130 may be positioned on (and/or at least partially in) a first retainer 140 in the inner sleeve 120. The first retainer 140 engages the ball 130 to resist the ball 130 from moving farther in the downhole direction and into the plug 200. The first retainer 140 may be or include a flexible ring that is positioned at least partially in a circumferential recess formed in an inner surface of the inner sleeve 120. In other embodiments, the first retainer 140 may be or include an O-ring, a bonded seal, sprung dogs, or another restriction. As described in greater detail below, the ball 130 may be configured to pass through the first retainer 140 when a downward force on the ball 130 exceeds a predetermined amount.

A second retainer 150 may also be positioned in the inner sleeve 120 and prevent the ball 130 from moving farther in the downhole direction and into the plug 200. In an embodiment, the ball 130 may rest on the second retainer 150 during run-in, e.g., while also engaging the first retainer 140. The second retainer 150 may prevent the ball 130 from moving past the first retainer 140.

In some embodiments, the second retainer 150 may be or include one or more hinge(s) 152 and one or more gate(s) 154. The hinges 152 may be secured into reciprocal holes formed in the inner sleeve 120. The gate 154 may be configured to pivot around the hinge 152 (or potentially with the hinge 152, as the hinge 152 pivots with respect to the inner sleeve 120) from a first position to a second position. The gate 154 may be held in the first position (e.g., via contact with the mandrel 220) before the plug 200 is set. The gate 154 may prevent the ball 130 from moving through the first retainer 140, through the second retainer 150 (e.g., the gate 154 itself), and/or into the plug 200 when in the first position, even when the downward force on the ball 130 exceeds the predetermined amount otherwise sufficient to move the ball 130 past the first retainer 140.

The mandrel 220 may move away from the gate 154 after the plug 200 is set as the wireline adapter kit 100 (i.e., the inner sleeve 120) is decoupled from the plug 200 (i.e., the mandrel 120), allowing the gate 154 to move into the second position. As described in greater detail below, the ball 130 may then pass through the first retainer 140 and the second retainer 150 (e.g., the gate 154) in the downhole direction and into the plug 200 when the gate 154 is in the second position.

Figure 3:
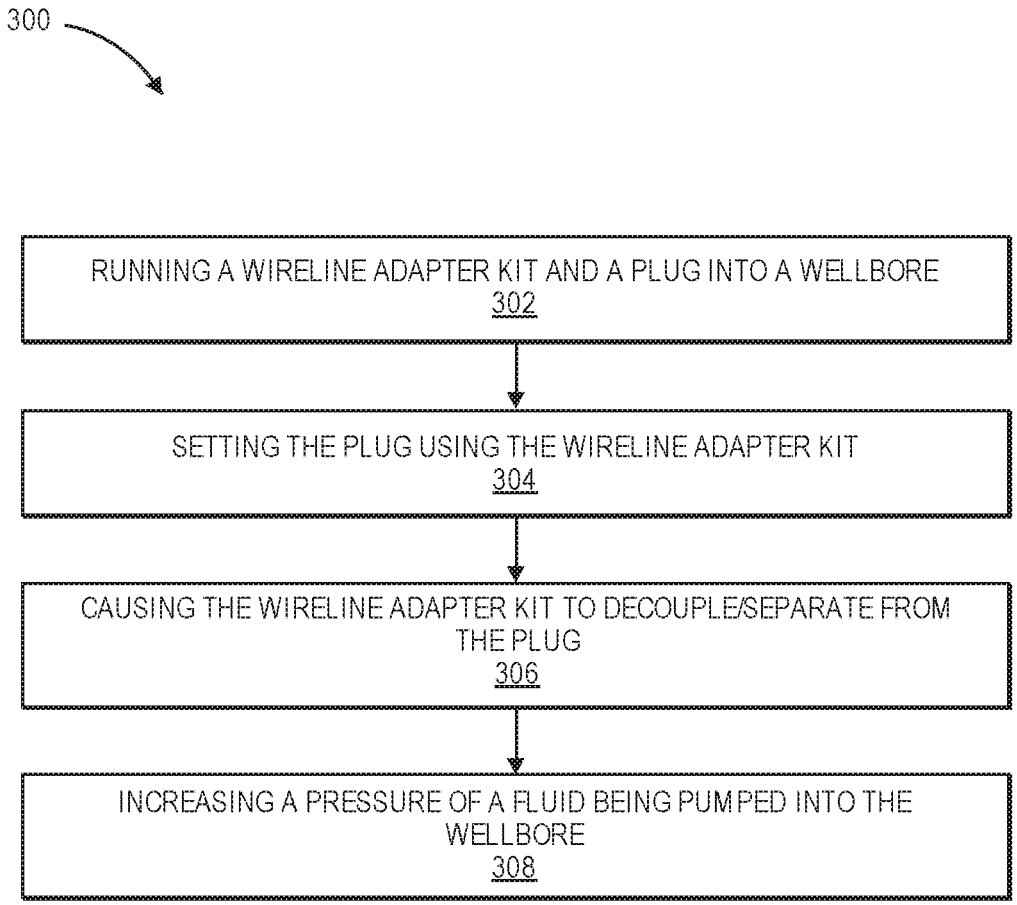
FIG. 3 illustrates a flowchart of a method for setting the plug using the wireline adapter kit, according to an embodiment.
Figure 4:
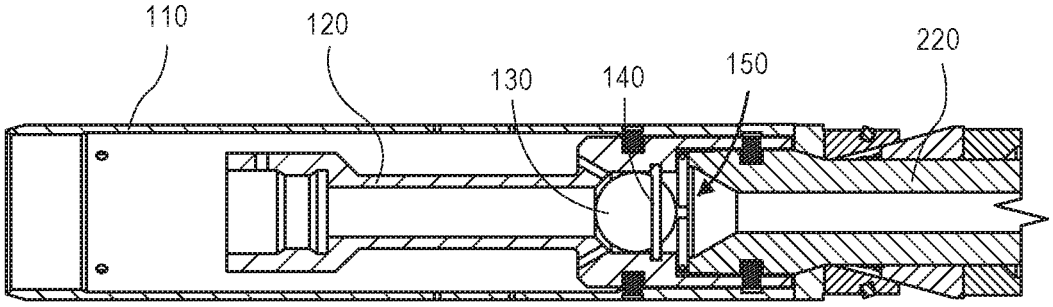
FIG. 4 illustrates a side, cross-sectional view of a portion of the wireline adapter kit in a run-in state, according to an embodiment.
Figure 5:
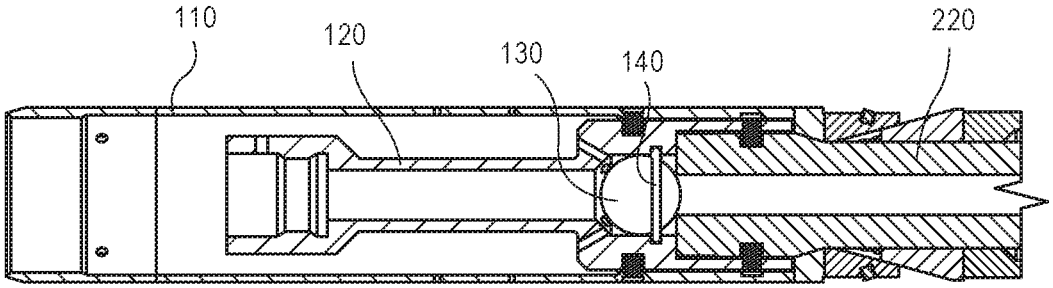
FIG. 5 illustrates a side, cross-sectional view of a portion of the wireline adapter kit in an alternative run-in state, according to an embodiment.

FIG. 3 illustrates a flowchart of a method 300 for setting the plug 200 using the wireline adapter kit 100, according to an embodiment. The method 300 may include running the wireline adapter kit 100 and the plug 200 into a wellbore, as at 302. The outer sleeve 110 of the wireline adapter kit 100 may be in contact with the load ring 210, and the inner sleeve 120 of the wireline adapter kit 100 may be coupled to the mandrel 220 as the wireline adapter kit 100 and the plug 200 are run into the wellbore. In addition, the ball 130 may be positioned in the inner sleeve 120 as the wireline adapter kit 100 and the plug 200 are run into the wellbore. More particularly, the ball 130 may be positioned on/in the first retainer 140, and the first retainer 140 and/or the second retainer 150 may prevent the ball 130 from moving into the plug 200, as shown in FIG. 4. FIG. 5 illustrates an alternative embodiment for running the wireline adapter kit 100 and the plug 200 into the wellbore in which the upper axial end of the mandrel 220 is shaped to prevent the ball 130 from moving into the plug 200. In this alternative embodiment, the mandrel 220 may be considered to be (or otherwise serve as) the second retainer, which actuates between the first position and the second position again by or otherwise in response to setting of the plug 200.

The method 300 may include setting the plug 200 using the wireline adapter kit 100, as at 304. As described above, this may include pushing the outer sleeve 110 toward the plug 200 and/or pulling the inner sleeve 120 upward and away from the plug 200. These opposing forces may cause the one or more first fasteners (e.g., shear screws) 122 to shear/break, thereby allowing the outer sleeve 110 and the load ring 210 to move with respect to the inner sleeve 120 and the mandrel 220. This movement may cause one or more components (e.g., the sealing element(s) 230) positioned around the mandrel 220 of the plug 200 to be axially-compressed between the load ring 210 and the shoulder or shoe 240 (see FIG. 1). The axial compression may cause the sealing element(s) 230 to expand radially-outward to engage a surrounding tubular (e.g., a liner, a casing, a wellbore wall, etc.) as the plug 200 is set in the wellbore.

Figure 6:
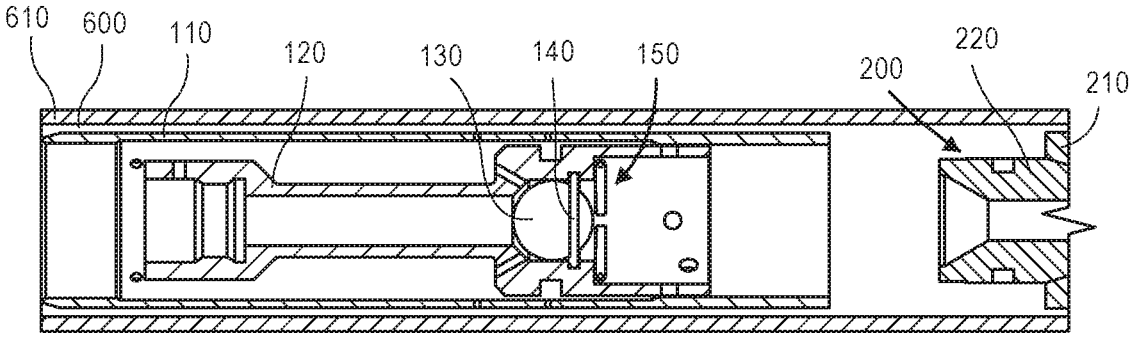
FIG. 6 illustrates a side, cross-sectional view of a portion of the wireline adapter kit after the plug is set and before the ball passes through a first retainer and a second retainer, according to an embodiment.

FIG. 6 illustrates a side, cross-sectional view of a portion of the wireline adapter kit 100 and the top of the plug 200 at this stage, after the plug 200 is set and before the ball 130 passes through the first and second retainers 140, 150, according to an embodiment. The ball 130 may remain positioned within the inner sleeve 120 of the wireline adapter kit 100 as the plug 200 is set. More particularly, the ball 130 may be positioned on/in the first retainer 140 as the plug 200 is set, with the ball 130 being prevented from dropping by engagement with the first retainer 140. In this manner, if the perforation guns do not actuate, the ball 130 is restrained from blocking flow through the mandrel 220. The ball 130 can be pulled out of the hole with the wireline adapter kit 100 allowing flow through the set plug 200. This allows the contingent set of perforation guns to be pumped down to the portion of the wellbore to be treated, saving the time and cost to rig-up coil tubing to push the contingent set of perforation guns downhole.

In a successful setting of the plug 200, the method 300 may proceed to causing the wireline adapter kit 100 to decouple/separate from the plug 200, as at 306. After the plug 200 is set, the opposing forces exerted on the load ring 210 and the mandrel 220 by the outer sleeve 110 and the inner sleeve 120, respectively, may be increased, causing the wireline adapter kit 100 to decouple/separate from the plug 200. More particularly, the one or more second fasteners (e.g., shear screws) 222 that were used to couple the inner sleeve 120 to the mandrel 220 may shear/break in response to the increased force, allowing the wireline adapter kit 100 to move back toward the surface while the plug 200 remains set in the wellbore.

After the wireline adapter kit 100 is decoupled from the plug 200, the second retainer 150 may be free to actuate from the first position to the second position. This may be because the gate 154 is no longer restricted from pivoting from the first position to the second position due to its prior contact with the mandrel 220, as in FIG. 4. In the embodiment of FIG. 5, where the mandrel 220 is the second retainer, the mandrel 220 may move from the first position (e.g., when coupled) to the second positon (e.g., when de-coupled). In at least one embodiment, the ball 130 may be/remain positioned in the inner sleeve 120 (e.g., in the first retainer 140), at least temporarily, when the wireline adapter kit 100 is decoupled/separated from the plug 200. In the embodiment The method 300 may also include increasing a pressure differential across the ball 130, as at 308. The pressure may increase, for example, by increasing a pressure of a fluid pumped into the wireline. Alternatively, the pressure of the fluid may be increased by (e.g., quickly) moving the wireline adapter kit 100 back toward the surface, so that fluid pressure on the ball 130 increases (e.g., due to the bypass annulus 600 having a small area). The fluid may flow through a reduced bypass annulus 600 between the outer surface of the outer sleeve 110 and an inner surface of a surrounding tubular (e.g., a casing) 610, generating a pressure drop that causes the downward force exerted on the ball 130 to exceed the predetermined amount. The pressure of the fluid may be increased after the plug 200 is set and/or after the wireline adapter kit 100 is decoupled from the plug 200 by pumping 5 or more barrels per minute (BPM) into the wellbore.

Figure 7:
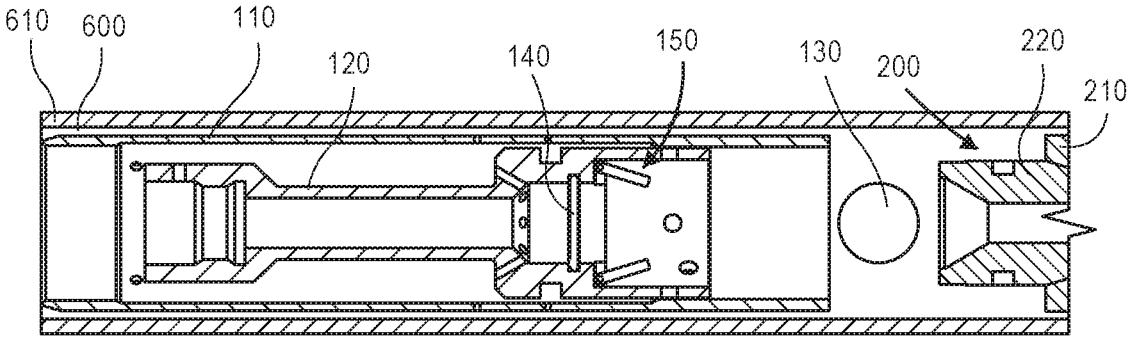
FIG. 7 illustrates a side, cross-sectional view of a portion of the wireline adapter kit after the plug is set and after the ball passes through the first retainer and the second retainer, according to an embodiment.

As a result, the ball 130 and/or the first retainer 140 may temporarily deform to allow the ball 130 to pass through the first retainer 140. With the second retainer 150 now free to actuate (or having already actuated) into the second position, the ball 130 may move past the second retainer 150 and out of the wireline adapter kit 100 and into the plug 200. This is shown in FIG. 7.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

an outer sleeve;

an inner sleeve positioned at least partially within the outer sleeve;

an impediment positioned at least partially within the inner sleeve;

a first retainer positioned at least partially within the inner sleeve, wherein the first retainer is configured to prevent the impediment from passing therethrough when a force on the impediment is less than a predetermined amount, and wherein the impediment, the first retainer, or both are configured to allow the impediment to pass through the first retainer when the force on the impediment is greater than the predetermined amount;

a second retainer configured to actuate between a first position and a second position, wherein the second retainer in the first position is configured to prevent the impediment from passing through the first retainer even when the force is greater than the predetermined amount, and wherein the second retainer in the second position is configured to allow the impediment to pass through the first retainer; and a mandrel of a plug, wherein the mandrel is initially coupled to the inner sleeve, and wherein the mandrel comprises a seat that is configured to receive the impediment after the impediment passes through the first retainer and after the mandrel is decoupled from the inner sleeve.

2. The downhole tool of claim 1, wherein the first retainer comprises a ring positioned at least partially within the inner sleeve.

3. The downhole tool of claim 1, wherein the second retainer is also configured to prevent the impediment from passing through the second retainer when the second retainer is in the first position.

4. The downhole tool of claim 1, wherein the impediment, the first retainer, or both is configured to deform to allow the impediment to pass through the first retainer when the force on the impediment is greater than the predetermined amount.

5. A downhole tool, comprising:

an outer sleeve;

an inner sleeve positioned at least partially within the outer sleeve;

an impediment positioned at least partially within the inner sleeve;

a first retainer positioned at least partially within the inner sleeve, wherein the first retainer is configured to prevent the impediment from passing therethrough when a force on the impediment is less than a predetermined amount, and wherein the impediment, the first retainer, or both are configured to allow the impediment to pass through the first retainer when the force on the impediment is greater than the predetermined amount; and a second retainer positioned at least partially within the inner sleeve, wherein the second retainer comprises a hinge and a gate, and wherein the gate is configured to pivot from a first position to a second position, wherein the gate in the first position is configured to prevent the impediment from passing through the first retainer even when the force is greater than the predetermined amount, and wherein the gate in the second position is configured to allow the impediment to pass through the first retainer.

6. The downhole tool of claim 5, further comprising a mandrel of a plug, wherein the mandrel is initially coupled to the inner sleeve, and wherein the mandrel comprises a seat that is configured to receive the impediment after the impediment passes through the first retainer and after the mandrel is decoupled from the inner sleeve.

7. A downhole tool, comprising:

an outer sleeve;

an inner sleeve positioned at least partially within the outer sleeve;

an impediment positioned at least partially within the inner sleeve;

a first retainer positioned at least partially within the inner sleeve, wherein the first retainer is configured to prevent the impediment from passing therethrough when a force on the impediment is less than a predetermined amount, and wherein the impediment, the first retainer, or both are configured to allow the impediment to pass through the first retainer when the force on the impediment is greater than the predetermined amount; and a second retainer comprising a mandrel of a plug, wherein the mandrel is configured to actuate between a first position and a second position, wherein the mandrel is coupled to the inner sleeve and configured to prevent the impediment from passing through the first retainer even when the force is greater than the predetermined amount when the mandrel is in the first position, and wherein the mandrel is decoupled from the inner sleeve and configured to allow the impediment to pass through the first retainer when the mandrel is in the second position.

8. A system for isolating a portion of a wellbore, comprising:

a wireline adapter kit comprising:

an outer sleeve;

an inner sleeve positioned at least partially within the outer sleeve;

an impediment positioned at least partially within the inner sleeve;

a first retainer positioned at least partially within the inner sleeve, wherein the first retainer is configured to prevent the impediment from passing therethrough when a force on the impediment is less than a predetermined amount, and wherein the impediment, the first retainer, or both are configured to deform to allow the impediment to pass through the first retainer when the force on the impediment is greater than the predetermined amount; and a second retainer configured to actuate between a first position and a second position, wherein the second retainer in the first position is configured to prevent the impediment from passing through the first retainer, and wherein the second retainer in the second position is configured to allow the impediment to pass through the first retainer; and a plug configured to be coupled to the inner sleeve, wherein the plug comprises a setting assembly comprising one or more expandable components, and wherein the outer sleeve pushes on the setting assembly.

9. The system of claim 8, wherein the plug comprises a mandrel positioned at least partially inside of the setting assembly, wherein the inner sleeve is coupled to the mandrel, wherein the inner sleeve pulling on the mandrel and the outer sleeve pushing on the setting assembly sets the plug, and wherein the impediment is positioned at least partially within the inner sleeve at least before the plug is set.

10. The system of claim 9, wherein the impediment is configured to remain positioned at least partially within the inner sleeve after the plug is set.

11. The system of claim 9, wherein the second retainer is configured to prevent the impediment from passing through the first retainer when the second retainer is in the first position, even when the force on the impediment is greater than the predetermined amount.

12. The system of claim 9, wherein the second retainer is secured in the first position by the mandrel when the mandrel is coupled to the inner sleeve.

13. The system of claim 12, wherein the inner sleeve is configured to be decoupled from the mandrel after the plug is set, and wherein the second retainer is configured to actuate into the second position when the inner sleeve decouples from the mandrel.

14. The system of claim 13, wherein the impediment is configured to remain positioned at least partially within the inner sleeve, at least temporarily, after the inner sleeve is decoupled from the mandrel.

15. The system of claim 14, wherein the impediment is configured to pass through the first retainer and the second retainer and into the plug, after the inner sleeve is decoupled from the mandrel, in response to the force on the impediment exceeding the predetermined amount.

16. The system of claim 8, wherein the second retainer comprises a mandrel of the plug, wherein the mandrel is positioned at least partially inside of the setting assembly.

17. A method for actuating a plug in a wellbore, comprising:

running a wireline adapter kit and the plug into the wellbore, wherein an inner sleeve of the wireline adapter kit is coupled to a mandrel of the plug as the wireline adapter kit and the plug are run into the wellbore, and wherein a first retainer is positioned at least partially within the inner sleeve and prevents an impediment in the inner sleeve from passing therethrough and into the plug when a force on the impediment is less than a predetermined amount;

setting the plug in the wellbore using the wireline adapter kit;

decoupling the inner sleeve from the mandrel after the plug is set, which allows a second retainer in the inner sleeve, the mandrel, or both to actuate from a first position that prevents the impediment from passing through the first retainer to a second position that allows the impediment to pass through the first retainer; and increasing a pressure differential across the impediment after the wireline adapter kit is decoupled from the plug, thereby causing force on the impediment to exceed the predetermined amount such that the impediment passes through the first retainer and into the plug.

18. The method of claim 17, wherein the second retainer in the inner sleeve, the mandrel, or both, when in the first position, prevents the impediment from passing through the first retainer, even when the force on the impediment is greater than the predetermined amount.

19. The method of claim 17, wherein the first retainer comprises an elastomeric ring, and wherein the second retainer comprises a gate that pivots around a hinge to actuate from the first position to the second position.

20. The method of claim 17, wherein the second retainer comprises a plurality of gates that are circumferentially-offset from one another in the inner sleeve.

* * * * *